US006924595B2

(12) United States Patent
Wang et al.

(10) Patent No.: US 6,924,595 B2
(45) Date of Patent: Aug. 2, 2005

(54) DAMPING AND MUFFLING STRUCTURE FOR EL CELL

(75) Inventors: Chih-Yuan Wang, Taichung Hsien (TW); Heng Yi Chang, Taipei (TW)

(73) Assignee: Wintek Corporation, Taichung (TW)

( * ) Notice: Subject to any disclaimer, the term of this patent is extended or adjusted under 35 U.S.C. 154(b) by 137 days.

(21) Appl. No.: 10/449,060

(22) Filed: Jun. 2, 2003

(65) Prior Publication Data

US 2004/0238269 A1 Dec. 2, 2004

(51) Int. Cl.[7] ..... H05B 33/26; H01J 1/18

(52) U.S. Cl. ..... 313/506; 313/269; 315/169.3

(58) Field of Search ..... 313/498–509, 313/512, 269; 428/690, 917, 425, 269; 315/169.3, 169.1; 181/202, 207; 345/76

(56) References Cited

U.S. PATENT DOCUMENTS 4,743,808 A * 5/1988 Mitsumori ..... 315/169.3
6,459,211 B1 * 10/2002 Wang ..... 315/169.3
6,696,795 B1 * 2/2004 Wang ..... 315/169.3
2004/0085013 A1 * 5/2004 Han et al. ..... 313/503
2005/0012693 A1 * 1/2005 Wang et al. ..... 345/76

FOREIGN PATENT DOCUMENTS

JP 11273872 A * 10/1999 ..... H05B/33/26
JP 2001230083 A * 8/2001 ..... H05B/33/26
WO WO 00/72638 A1 * 11/2000 ..... H05B/33/26

* cited by examiner

*Primary Examiner*—Karabi Guharay
(74) *Attorney, Agent, or Firm*—Rosenberg, Klein & Lee

(57) ABSTRACT

Damping and muffling structure for EL cell includes a transparent substrate, a front electrode layer, a lighting layer, an inducing layer and an insulating layer that are sequentially overlaid on the substrate. A back electrode layer and a conductive member are laid on the inducing layer. The conductive member is adjacent to the back electrode layer without contacting therewith. The conductive member is laid on both the inducing layer and the front electrode layer to electrically connect the inducing layer with the front electrode layer. The front electrode layer is connected to a grounding electrode of the driving circuit, whereby the conductive member can quickly remove the charge accumulating on the inducing layer so as to minify or even eliminate the vibration and noise of the EL cell.

3 Claims, 3 Drawing Sheets

DAMPING AND MUFFLING STRUCTURE FOR EL CELL

BACKGROUND OF THE INVENTION

The present invention is related to a damping and muffling structure for EL cell, and more particularly to a damping and muffling structure that is able to minify or even eliminate the vibration and noise caused by electromagnetic interference (abbreviated into EMI hereafter) created by A.C. electric field.

The conventional electroluminescent cell (EL cell) is a thin sheet and mainly used as backlight cell of PDA, mobile phone, etc. FIG. 5 shows a conventional EL cell composed of a transparent substrate 81, a front electrode layer 82, a lighting layer 83, an inducing layer 84, a back electrode layer 85 and an insulating layer 86. By means of a driving circuit, an AC voltage is applied to the front and back electrode layers 82, 85 to make the lighting layer 83 emit light.

When AC electric field acts on the inducing layer 84, due to EMI effect, the charge will accumulate on the inducing layer 84 to create surface energy conservation effect. The surface energy conservation effect will make uneven charge distribution on the inducing layer 84 and create piezoelectric effect. The piezoelectric effect will lead to vibration of the EL cell to emit noise. This affects the quality of the EL cell or even interferes with the driving of the LCD module.

In order to solve the problems of vibration and noise of the conventional EL cell caused by AC electric field, generally the EL cell is backed to increase the thickness thereof so as to minify the vibration and noise. Alternatively, the EL cell is tightly attached to the circuit board to reduce vibration and noise.

However, the EL cell applied to small-size electronic products such as mobile phones is limited in thickness specification. Therefore, the backing will lead to excessive thickness. On the other hand, the EL cell can be attached to the circuit board to reduce over 60% noise. However, it is difficult to assemble the module and the use of double-face tape will lead to increased cost.

SUMMARY OF THE INVENTION

It is therefore a primary object of the present invention to provide a damping and muffling structure for EL cell. The damping and muffling structure includes a conductive member that can quickly conduct the charge accumulating on the inducing layer to a grounding electrode so as to minify or even eliminate the vibration and noise caused by AC electric field.

According to the above object, the damping and muffling structure of the present invention includes a transparent substrate, a front electrode layer, a lighting layer, an inducing layer and an insulating layer for packaging the EL cell. The transparent front electrode layer, lighting layer, inducing layer and insulating layer are sequentially overlaid on the substrate. A back electrode layer and at least one conductive member are laid on the inducing layer. The conductive member is adjacent to the back electrode layer without contacting therewith. The conductive member is laid on both the inducing layer and the front electrode layer. The front and back electrode layers are connected with a driving circuit. The front electrode layer is connected to a grounding electrode of the driving circuit, whereby the conductive member can conduct the charge accumulating on the inducing layer so as to minify or even eliminate the vibration and noise caused by AC electric field.

The present invention can be best understood through the following description and accompanying drawings wherein:

DETAILED DESCRIPTION OF THE PREFERRED EMBODIMENTS

Figure 1:
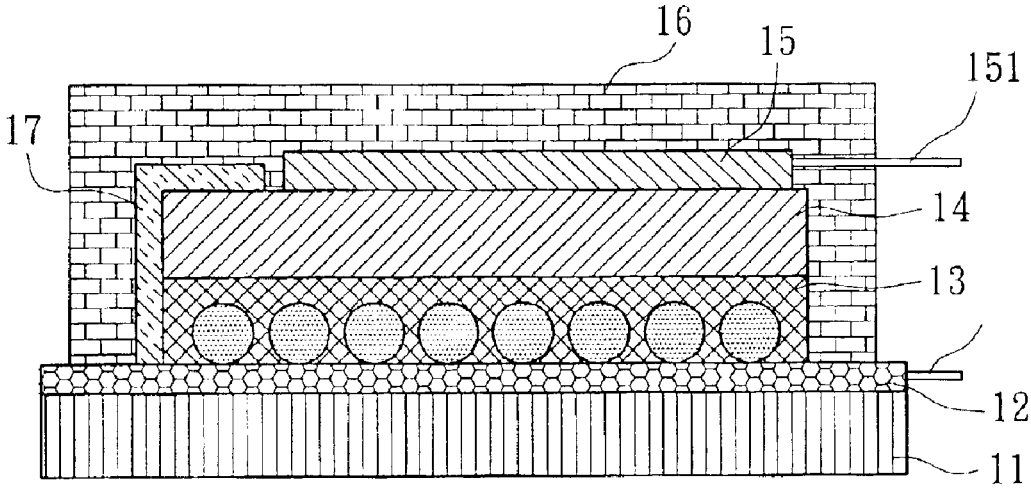
FIG. 1 is a sectional view of a first embodiment of the EL cell of the present invention.
Figure 2:
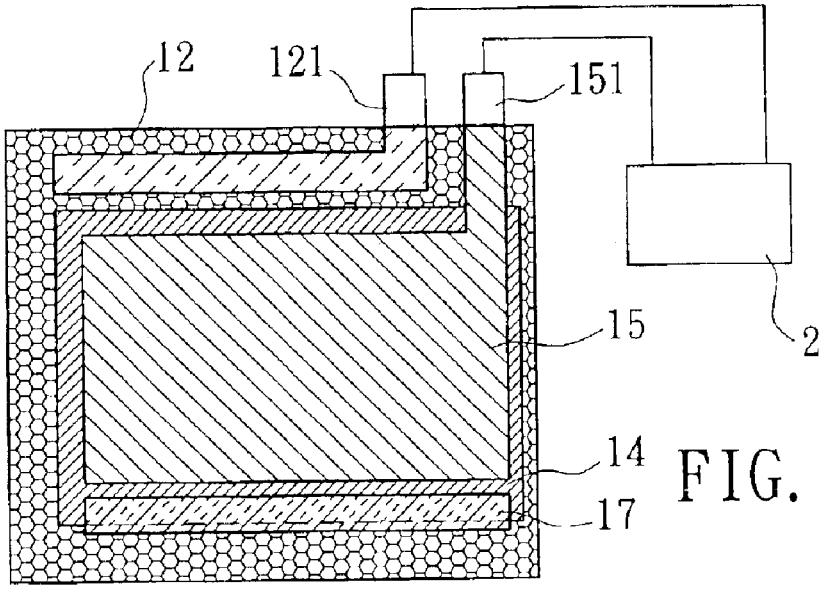
FIG. 2 is a top view of the first embodiment of the EL cell of the present invention.

Please refer to FIGS. 1 and 2. The damping and muffling structure for EL cell of the present invention includes a transparent substrate 11, a transparent front electrode layer 12 (which in this embodiment is ITO bus-bar), a lighting layer 13 composed of numerous lighting particles, an inducing layer 14, a back electrode layer 15 and an insulating layer 16 for packaging the EL cell. The transparent front electrode layer 12, lighting layer 13, inducing layer 14, back electrode layer 15 and insulating layer 16 are sequentially overlaid on the substrate 11. The front and back electrode layers 12, 15 are respectively connected with two outward extending conductive terminals 121, 151 for connecting with a driving circuit 2. A conductive member 17 is laid on the inducing layer 14. The conductive member 17 is adjacent to the back electrode layer 15 without contacting therewith. The conductive member 17 is laid on both the inducing layer 14 and the front electrode layer 12 to electrically connect the inducing layer 14 and the front electrode layer 12. The front electrode layer 12 is connected to the grounding electrode of the driving circuit 2, whereby the conductive member 17 can conduct the charge accumulating on the inducing layer.

In this embodiment, only one conductive member 17 is disposed and attached to one side of the inducing layer 14 as shown in FIG. 2. The conductive member 17 can be made of a material including silver gum, carbon gum and metal, the resistance of the surface of which is less than $10^{13}$ Ω/square measure. The less the surface resistance is, the better the conduction effect is.

The EL cell can be deemed a capacitor sheet. Therefore, when the driving circuit applies AC voltage between the front electrode layer 12 and the back electrode layer 15 for driving the lighting layer 13 to emit light, due to EMI effect, the charge will accumulate on the inducing layer 14 to create surface energy conservation effect. The surface energy conservation effect will make uneven charge distribution on the inducing layer 14 and create piezoelectric effect. The piezoelectric effect will lead to vibration of the EL cell to emit noise.

The conductive member 17 of the present invention is made of the conductive material including silver gum, carbon gum and metal, which is able to conduct the charge. In addition, the front electrode layer 12 electrically connected with the conductive member 17 is connected to the grounding electrode of the driving circuit 2. Therefore, the charge accumulating on the inducing layer 14 can be quickly conducted to the grounding electrode to weaken the piezoelectric effect caused by the unevenly distributed charge and minify or even eliminate the vibration and noise.

It is shown according to the data of an actual test of this applicant that the EMI value of the conventional EL cell without the conductive member is 1.23V. Under such circumstance, human ears can hear the noise. The EMI value of the EL cell of the present invention is 0.99V. In comparison with the conventional EL cell, the EMI value of the EL cell of the present invention is about 20% reduced. Human ears can hardly hear the noise emitted by the EL cell of the present invention. Therefore, the muffling effect of the present invention is apparent.

Figure 3:
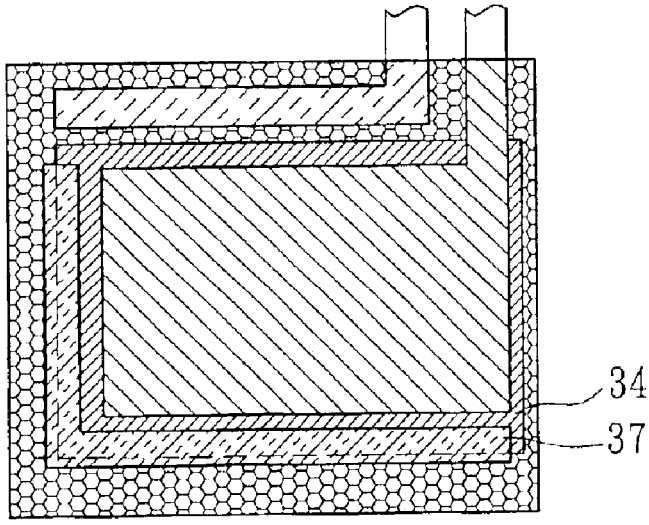
FIG. 3 is a plane view of a second embodiment of the present invention.
Figure 4:
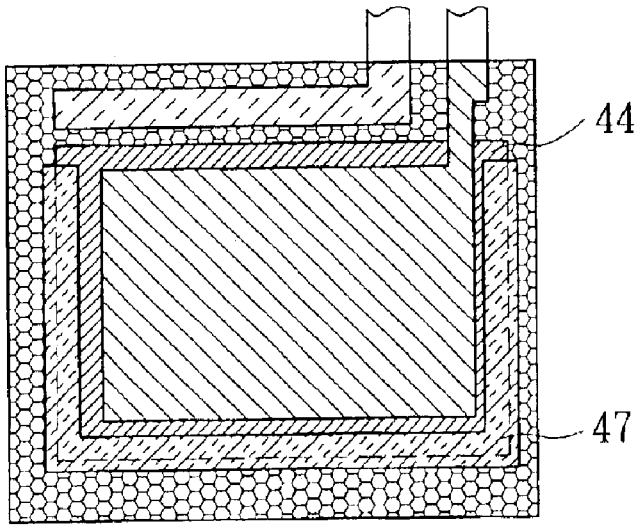
FIG. 4 is a plane view of a third embodiment of the present invention.
Figure 5:
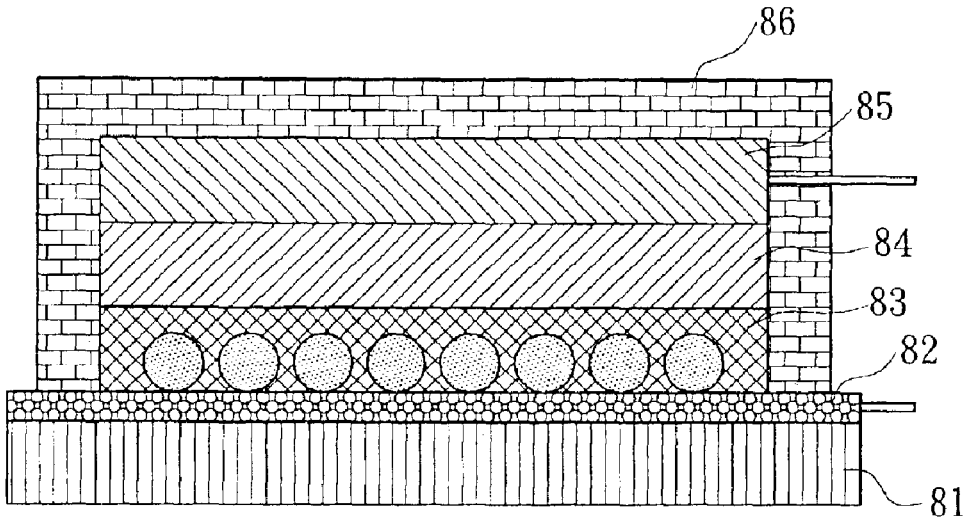
FIG. 5 PRIOR ART
FIG. 5 is a sectional view of a conventional EL cell.

The above embodiment is only used to illustrate the present invention, not intended to limit the scope thereof. Many modifications of the above embodiment can be made without departing from the spirit of the present invention. FIG. 3 shows a second embodiment of the present invention, in which the conductive member 37 extends to contact with two sides of the inducing layer 34. FIG. 4 shows a third embodiment of the present invention, in which the conductive member 47 encloses and contacts with three sides of the inducing layer 44. These can achieve the same effect as the first embodiment.

What is claimed is:

1. A damping and muffling structure for an EL cell, comprising:

a transparent substrate;

a transparent front electrode layer overlaying the substrate;

a lighting layer overlaying the transparent front electrode layer;

an inducing layer overlaying the lighting layer;

a back electrode layer at least partially overlaying the inducing layer;

a conductive member overlaying directly on a portion of the inducing layer and a portion of the transparent front electrode layer to make electrical contact therewith, the conductive member being laterally spaced from the back electrode layer on the inducing layer; and, an insulating layer for packaging the EL cell, the transparent front electrode layer and the back electrode layer being connected with a driving circuit, the transparent front electrode layer being connected to a grounding electrode of the driving circuit, the conductive member thereby providing a conductive path for an accumulated charge from the inducing layer to the grounding electrode.

2. The damping and muffling structure for an EL cell as claimed in claim 1, wherein the conductive member is disposed in spaced relationship along two lateral sides of the back electrode layer.

3. The damping and muffling structure for an EL cell as claimed in claim 1, wherein the conductive member is disposed in spaced relationship along three lateral sides of the back electrode layer.

* * * * *